US005409391A

United States Patent [19]

Raby

[11] Patent Number: 5,409,391

[45] Date of Patent: Apr. 25, 1995

[54] FLUORESCENT TUBE WITH CONTACT ALIGNMENT MARKING

[76] Inventor: Bruce R. Raby, 3030 N. Middle Side Road, Amherstburg, Ontario, Canada, N9V 2Y9

[21] Appl. No.: 104,364

[22] Filed: Aug. 9, 1993

[51] Int. Cl.[6] ..... H01R 33/02

[52] U.S. Cl. ..... 439/239; 439/488; 439/491

[58] Field of Search ..... 439/239, 240, 241, 488, 439/489, 491; 313/318; 362/260

[56] References Cited

U.S. PATENT DOCUMENTS 2,918,645 12/1959 Krupp ..... 439/240 X 4,702,539 10/1987 Cusick, III et al. ..... 439/491 X

*Primary Examiner*—Khiem Nguyen

*Attorney, Agent, or Firm*—John R. Benefiel

[57] ABSTRACT

A fluorescent tube is provided with markings at each end aligned with the base contacts and readily viewed from below allowing the pin contacts to be readily aligned with a fixture socket and thereby to facilitate installation of the tube into the fixture.

7 Claims, 2 Drawing Sheets

FLUORESCENT TUBE WITH CONTACT ALIGNMENT MARKING

BACKGROUND OF THE INVENTION

This invention concerns fluorescent tubes widely used in overhead lighting fixtures, such as are common in offices and commercial establishments. The vast numbers of tubes required and the need for regular replacement of burned out tubes creates a significant maintenance burden. Replacement of the tubes is slowed by the need to align the pin contacts at each end of the tube with an entry slot in the mating socket as the tube is pushed up into the socket, and thereafter rotated to complete the installation. Similarly, proper alignment of the tube is necessary for recessed double control base type fluorescent tubes. Since the tubes are usually four feet long and being installed in fixtures recessed into the ceiling, significant difficulty is encountered in properly aligning the contact base as the tube is installed since the pins cannot be viewed from the vantage point of the installer. If the contacts are not properly aligned, there is a possibility the tube will not be locked in the socket and will drop from the fixture after the tube is released.

Accordingly, it is the object of the present invention to facilitate the task of properly aligning the contacts of a fluorescent tube with the sockets during installation in a lighting fixture to in turn speed the tube replacement task.

SUMMARY OF THE INVENTION

The present invention comprises the arrangement of markings located at each end of the fluorescent tube providing an indication as to the location of the contacts, the markings readily viewable from a vantage point below and away from the tube ends. The markings can take the form of axial lines and/or "insert" word imprintings extending in from each end of the tube at a point aligned with the contacts.

Preferably, additional markings are provided rotated ninety degrees from the insert marking to provide a below viewable indication of completion of a proper installation.

DETAILED DESCRIPTION

Figure 6:
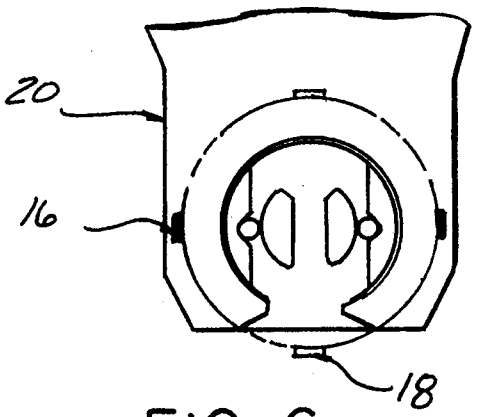
FIG. 6 is a diagrammatic end view of the tube and socket as shown in FIG. 4 and 5, with the tube rotated in the socket to complete the installation thereof.

In the following detailed description, certain specific terminology will be employed for the sake of clarity and in accordance with 35 USC 112, but the invention is not so limited as the invention may take many forms and variations in accordance with the appended claims.

Referring to the drawings, the fluorescent tube 10 is provided with sets of pairs of pin contacts 12, each supported by a metal base 14 on each tube end. The pin contacts 12 are arranged on either side of the center of the tube 10. The pin contacts pairs each thus define a radial plane.

According to the concept of the present invention, elongated pairs of markings 16 are imprinted at diametrically opposite locations on the tube exterior extending axially in from each end of the tube 10 in the axial plane defined by the pin contacts 12. The markings can take the form of the simple line shown or a suitable word such as "insert", or the line-word combination shown The marking is preferably on the glass tube 10 so as to be readily viewable from a vantage point below and away from the tube end during installation.

See U.S. Pat. No. 4,126,371 for a suitable process for marking the glass tube.

Alternatively, markings on the base 14 can be employed or combined with tube markings. Also, markings could be applied to a separate cover as a type shown in U.S. Pat. No. 3,808,495, issued Apr. 30, 1974, for a "Guard for Illumination Tubes".

Additional pairs of markings 18 can be employed, extending axially in from each end of the tube 10 at a point rotated ninety degrees from the first mentioned pairs of markings 16. The word "safe" may advantageously be used in combination with an elongated line in alignment therewith.

Figure 2:
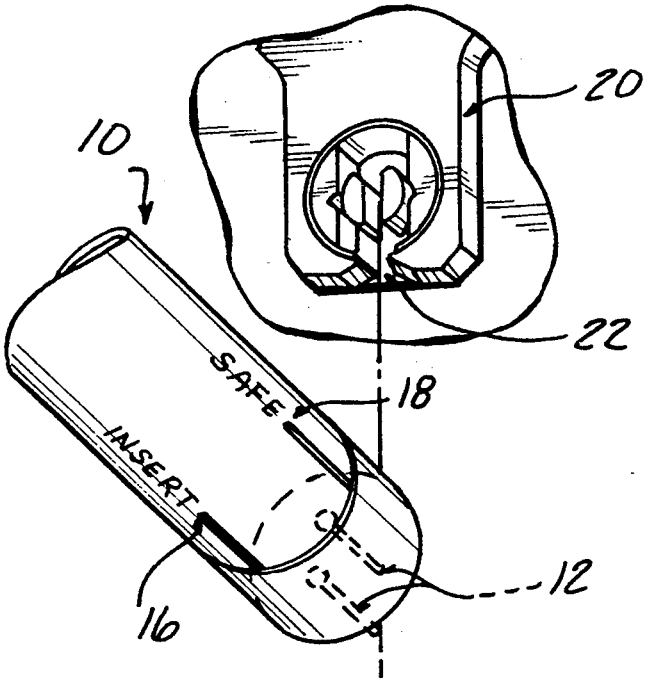
FIG. 2 is an enlarged fragmentary perspective view of an end of the tube shown in FIG. 1 and a fixture socket into which the tube is being installed, viewed from below and away from the tube end.

FIG. 2 shows the tube 10 positioned to be installed in a socket 20 with a slot 22 provided to receive the contact pins 12.

The marking 16 is readily viewed from below and away from the tube ends, and when positioned at the bottom by the installer, this results in the pin contacts 12 being vertically aligned, in proper position to pass into the slot 22.

Figure 3:
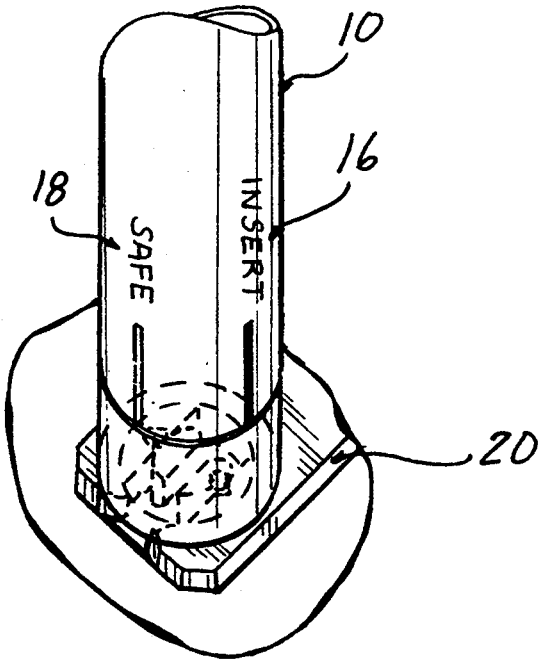
FIG. 3 is the same view of FIG. 2, with the tube completely installed.

After the tube 10 is inserted, it is rotated 90 degrees to complete the installation. At this time, the "safe" marking becomes visible at the bottom, as shown in FIG. 3.

Figure 5:
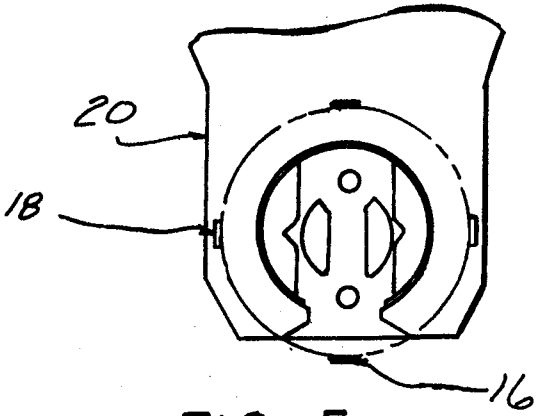
FIG. 5 is a diagrammatic end view of the tube and socket as shown in FIG. 4, with the tube moved into the socket.
Figure 4:
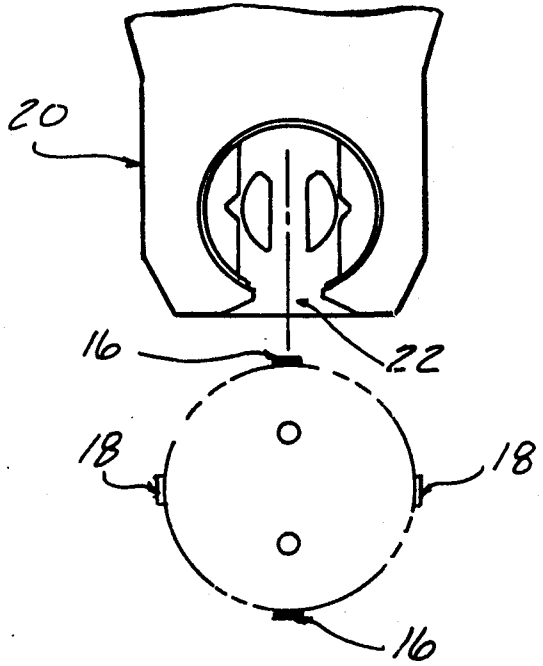
FIG. 4 is a diagrammatic end view of a tube and socket, with the tube in the initial position occurring during installation, with an exaggerated representation of the tube markings according to the present invention.
Figure 1:
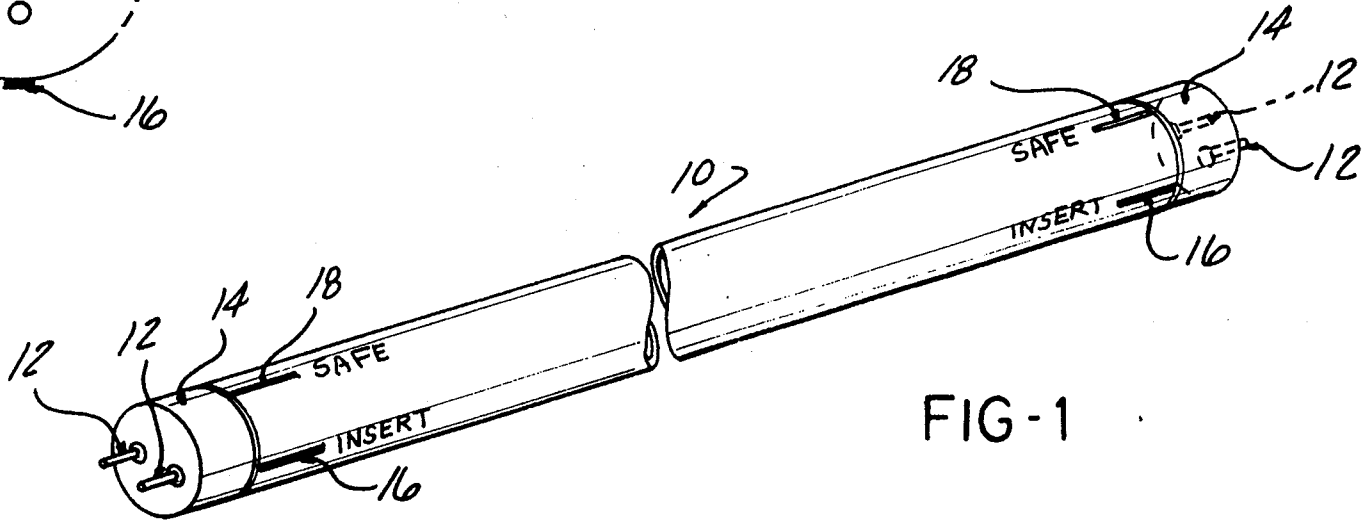
FIG. 1 is a fragmentary perspective view of a fluorescent tube having markings according to the present invention.

Each of the markings 16, 18 are provided in diametrically opposed pairs, as shown in FIGS. 4–6 so that one is visible no matter which tube side is closest to the installer.

The pin contact type tube is shown, but the concept is also applicable to the "recessed double contact base" type tube, as contacts at either tube end must still be aligned with a female socket.

I claim:

1. An elongated fluorescent tube having contacts extending axially from each end thereof for mating with an overhead light fixture socket, said tube carrying diametrically opposite pairs of markings extending in from each end of said tube, said markings aligned with said contacts and readily viewable from a vantage point below and away from said tube ends.

2. The fluorescent tube according to claim 1 further including second diametrically opposite pairs of markings extending in from either tube end, said second pairs of markings rotated ninety degrees from said first mentioned pairs of markings.

3. The fluorescent tube according to claim 1 wherein said tube contacts comprise pins extending axially from each tube end and defining a radial plane, each of said pairs of markings lying in said radial plane.

4. The fluorescent tube according to claim 1 wherein said pairs of markings comprise lines directly marked thereon.

5. The fluorescent tube according to claim 2 further including the word "insert" imprinted on said tube in alignment with each line marking.

6. The fluorescent tube according to claim 5 further including the word "safe" imprinted on said tube in alignment with each of said second pairs of markings.

7. A method of facilitating assembly of an elongated fluorescent tube having pin contacts at each end into an overhead light fixture socket, comprising the steps of applying markings located about the exterior of said tube, said markings aligned with said pin contacts and located at each end of said tube to be readily viewable from a vantage point below said tube, to allow said contacts to be properly aligned with said socket during installation.

* * * * *